US006536525B1

(12) United States Patent
Haugen et al.

(10) Patent No.: US 6,536,525 B1
(45) Date of Patent: Mar. 25, 2003

(54) METHODS AND APPARATUS FOR FORMING A LATERAL WELLBORE

(75) Inventors: David M. Haugen, League City, TX (US); Frederick T. Tilton, Spring, TX (US); Neil A. A. Simpson, Aberdeen (GB); Kevin L. Gray, Friendswood, TX (US); Robert Badrak, Sugarland, TX (US); David J. Brunnert, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/658,858

(22) Filed: Sep. 11, 2000

(51) Int. Cl.[7] ..... E21B 43/114
(52) U.S. Cl. ..... 166/297; 166/55.1; 175/4.6
(58) Field of Search ..... 166/117.6, 123, 166/297, 298, 55.2, 382; 175/4.6, 4.55

(56) References Cited

U.S. PATENT DOCUMENTS 2,506,799 A 5/1950 Livingston (List continued on next page.)

FOREIGN PATENT DOCUMENTS

| | | | |
|---|---|---|---|
| EP | 0819827 A2 * | 1/1998 | |
| EP | 0 819 827 A2 | 1/1998 | ..... E21B/29/06 |
| EP | 0 846 838 | 6/1998 | ..... E21B/29/02 |
| GB | 2 177 740 | 1/1987 | ..... E21B/29/02 |
| GB | 2 346 633 A | 8/2000 | |
| GB | 2 346 633 | 8/2000 | ..... E21B/29/02 |
| WO | WO 97/21903 | 6/1997 | ..... E21B/29/02 |
| WO | WO 99/64715 | 12/1999 | ..... E21B/29/06 |
| WO | WO 00/50727 | 8/2000 | ..... E21B/7/08 |
| WO | WO 00/66876 | 11/2000 | ..... E21B/29/00 |

OTHER PUBLICATIONS

PCT Partial International Search Report from PCT/GB 01/04045, Dated Jan. 31, 2002.
PCT International Search Report from International Application No. PCT/GB01/04045, Dated May 02, 2002.

*Primary Examiner*—Frank S. Tsay
(74) *Attorney, Agent, or Firm*—Moser, Patterson & Sheridan, L.L.P.

(57) ABSTRACT

The present invention discloses and claims methods and apparatus for forming an opening or a window in a downhole tubular for the subsequent formation of a lateral wellbore. In one aspect of the invention, a thermite containing apparatus is run into the wellbore on a wire line and a widow is subsequently formed in casing wall. In another aspect of the invention, the apparatus includes a run-in string or drill stem with a drill bit attached to a lower end thereof. A diverter, like a whipstock is attached temporarily to the drill bit with a mechanically shearable connection. At a lower end of the whipstock, a container is formed and connected thereto. The container is designed to house a predetermined amount of exothermic material at one side thereof adjacent the portion of casing where the window or opening will be formed. A telescopic joint extends between the bottom of the container and an anchor therebelow and the telescopic joint is in an extended position when the apparatus is run into a wellbore. In use, the exothermic material, like thermite is ignited and the window is formed in the casing. The telescopic joint is then caused to move to a second position, locating the whipstock adjacent the newly formed casing window.

40 Claims, 13 Drawing Sheets

U.S. PATENT DOCUMENTS

| | | | | | |
|---|---|---|---|---|---|
| 2,535,964 | A | | 12/1950 | Stanton | |
| 2,587,244 | A | | 2/1952 | Sweetman | |
| 2,649,046 | A | | 8/1953 | David | |
| 2,758,543 | A | | 8/1956 | Grandin | |
| 4,298,063 | A | | 11/1981 | Regalbuto et al. | |
| 4,534,423 | A | | 8/1985 | Regalbuto | |
| 4,598,769 | A | * | 7/1986 | Robertson | 166/297 |
| 4,798,244 | A | | 1/1989 | Trost | |
| 4,799,829 | A | | 1/1989 | Kenny | |
| 4,905,759 | A | | 3/1990 | Wesson et al. | |
| 4,960,171 | A | | 10/1990 | Parrott et al. | |
| 5,135,050 | A | | 8/1992 | Tailby | |
| 5,435,394 | A | | 7/1995 | Robertson | |
| 5,636,692 | A | | 6/1997 | Haugen | 166/298 |
| 5,690,171 | A | | 11/1997 | Winch et al. | |
| 5,709,265 | A | | 1/1998 | Haugen et al. | 166/55.2 |
| 5,791,417 | A | * | 8/1998 | Haugen et al. | 166/298 |
| 5,813,465 | A | | 9/1998 | Terrell et al. | |
| 5,862,862 | A | | 1/1999 | Terrell | |
| 6,016,753 | A | | 1/2000 | Glenn et al. | |
| 6,024,169 | A | * | 2/2000 | Haugen | 166/298 |
| 6,035,935 | A | | 3/2000 | Regalbuto | |
| 6,135,206 | A | | 10/2000 | Gano et al. | |
| 6,202,752 | B1 | * | 3/2001 | Kuck et al. | 166/298 |

* cited by examiner

METHODS AND APPARATUS FOR FORMING A LATERAL WELLBORE

BACKGROUND OF THE INVENTION

1. Field of the Invention

The present invention is related to apparatus and methods for forming a window in wellbore tubulars, more specifically the invention is related to forming a window in casing and drilling a lateral wellbore in a single trip.

2. Background of the Related Art

The practice of producing oil from multiple, radially dispersed reservoirs through a single primary wellbore has increased dramatically in recent years. Technology has developed that allows an operator to drill a vertical well and then continue drilling one or more angled or horizontal holes off of that well at chosen depth(s). Because the initial vertical wellbore is often cased with a string of tubular casing, an opening or "window" must be cut in the casing before drilling the lateral wellbore. The windows are usually cut using various types of milling devices and one or more "trips" into the primary wellbore is needed. Rig time is very expensive and multiple trips take time and add to the risk that problems will occur.

In certain multi-trip operations, an anchor, slip mechanism, or an anchor-packer is set in a wellbore at a desired location. This device acts as an anchor against which tools above it may be urged to activate different tool functions. The device typically has a key or other orientation indicating member. The device's orientation is checked by running a tool such as a gyroscope indicator or measuring-while-drilling device into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is releasably secured at the top of the whipstock, e.g. with a shearable setting stud and nut connected to a pilot lug on the whipstock. The tool is then lowered into the wellbore so that the anchor device or packer engages the stinger and the tool is oriented. Slips extend from the stinger and engage the side of the wellbore to prevent movement of the tool in the wellbore; and locking apparatus locks the stinger in a packer when a packer is used. Pulling on the tool then shears the setting stud, freeing the starting mill from the tool. Certain whipstocks are also thereby freed so that an upper concave portion thereof pivots and moves to rest against a tubular or an interior surface of a wellbore. Rotation of the string with the starting mill rotates the mill. The starting mill has a tapered portion which is slowly lowered to contact a pilot lug on the concave face of the whipstock. This forces the starting mill into the casing and the casing is milled as the pilot lug is milled off. The starting mill moves downwardly while contacting the pilot lug or the concave portion and cuts an initial window in the casing. The starting mill is then removed from the wellbore. A window mill, e.g. on a flexible joint of drill pipe, is lowered into the wellbore and rotated to mill down from the initial window formed by the starting mill. The tool is then removed from the wellbore and a drill string is utilized with a drill bit to form the lateral borehole in the formation adjacent the window. There has long been a need for efficient and effective wellbore casing window methods and tools useful in such methods particularly for drilling side or lateral wellbores. There has also long been a need for an effective "single trip" method for forming a window in wellbore casing whereby a window is formed and the lateral wellbore is drilled in a single trip.

There is a need therefore, for a window forming apparatus that includes fewer mechanical components. There is a further need for a window forming apparatus that requires fewer trips into a wellbore to complete formation of a window in casing.

SUMMARY OF THE INVENTION

The present invention discloses and claims methods and apparatus for forming an opening or a window in a downhole tubular for the subsequent formation of a lateral wellbore. In one aspect of the invention, a container having an exothermic material is lowered into a wellbore to a predetermined depth. Thereafter, the exothermic material is ignited and a portion of the casing therearound is destroyed, leaving a window in the casing. In another aspect of the invention, the apparatus includes a run-in string or drill stem with a drill bit attached to a lower end thereof. A diverter, like a whipstock is attached temporarily to the drill bit with a mechanically shearable connection. At a lower end of the whipstock, a container is formed and connected thereto. The container is designed to house a predetermined amount of exothermic material at one side thereof adjacent the area of casing where the window or opening will be formed. A telescopic joint extends between the bottom of the container and an anchor therebelow and the telescopic joint is in an extended position when the apparatus is run into a wellbore.

In an aspect of the invention, the window is formed in the casing by first locating the apparatus in a predetermined location in the wellbore and setting the anchor therein. Subsequently, a thermite initiator is activated, typically by a hydraulic line between the initiator and hydraulic ports formed in the drill bit. The initiator activates a thermite fuse and the chemical process within the package of thermite begins producing heat for a given amount of time adequate to form the window or hole in the adjacent casing. As the thermite burns, the melted casing and thermite material is urged into the container by formations formed at the upper and lower edges of the container. As the thermite completes its burning process, a telescopic joint fuse connected between the lower portion of the thermite package and the telescopic joint is activated and the telescopic joint, having an atmospheric chamber formed therein, begins to retract. As the joint retracts, the shearable connection between the drill and whipstock fails and the container and whipstock move downward to a predetermined, second axial position within the wellbore. In the second position, the whipstock is properly placed to guide the drill bit through the newly formed window in the casing. As the container moves downward, the formations at the upper and lower edge remove any slag from the inside perimeter of the newly formed window. With the whipstock physically separated from the drill stem and drill bit and the whipstock properly located and anchored in a position appropriate for formation of the lateral wellbore, the drill stem and rotating drill bit are extended to form the lateral welbbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered, limiting of its scope, for the invention may admit to other equally effective embodiments.

DETAILED DESCRIPTION OF THE PREFERRED EMBODIMENT

Figure 1:
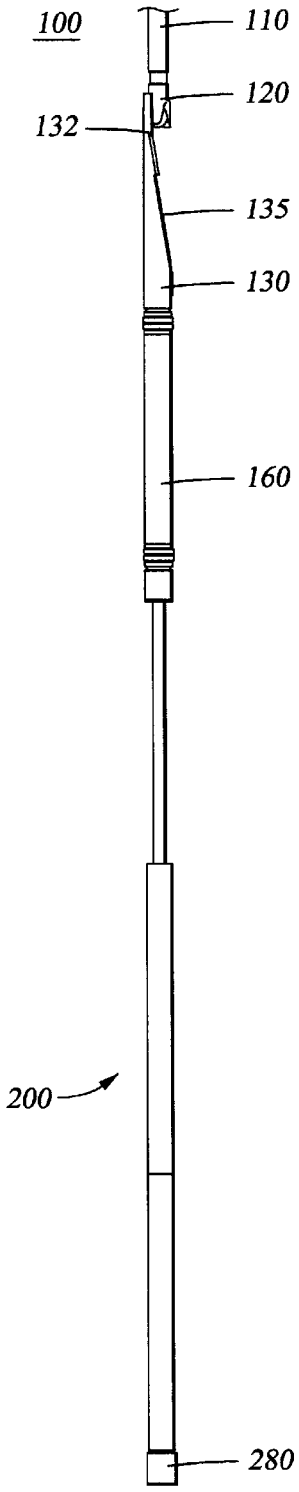
FIG. 1 is a view of the apparatus of the present invention including a drill string, drill bit, whipstock, container portion, telescopic joint and anchor.

FIG. 1 illustrates an apparatus 100 of the present invention as a single unit as it would be lowered into a wellbore. The apparatus includes drill stem 110, a drill bit 120 disposed at a lower end thereof, a diverter or whipstock 130 below the drill bit and attached to it with a shearable connection 132, typically including a threaded member designed to fail upon a predetermined compressive or tensile force applied between the drill bit and the whipstock. Fixed at a lower end of the whipstock is a container portion 160 which is designed to house a quantity of an exothermic heat energy source, like thermite and also designed to house any casing or thermite material remaining after the thermite reaction burns a hole or window in the casing wall as will be described hereafter. At a lower end of the container portion 160 is a telescopic joint 200 disposed between the container portion 160 and an anchor 280 therebelow. The telescopic joint is designed to move the whipstock and container portion thereabove from a first position to a lower, second position within the wellbore after the casing window is formed. The anchor 280 fixes the assembly in the wellbore at a predetermined location and its use is familiar to those of ordinary skill in the art.

The drill stem 110 is typically a tubular used to rotate a drill bit and in this instance, is also used as a run-in string for the apparatus. The drill bit 120 is also typical and includes formations at a lower end to loosen material as a wellbore is formed. In one embodiment of the invention, the drill bit also includes apertures running longitudinally therethrough providing a channel for fluid injected from the well surface through the drill stem 110 and the drill bit 120 into the formation while drilling is taking place. The whipstock 130 is well known in the art and includes a sloped portion 135 having a concave formed therein made of material adequate to withstand abrasive action of the rotating drill 120 bit as it moves across the sloped portion towards a newly formed window in the casing to access that portion of the adjacent formation where the lateral wellbore will be formed.

Figure 2:
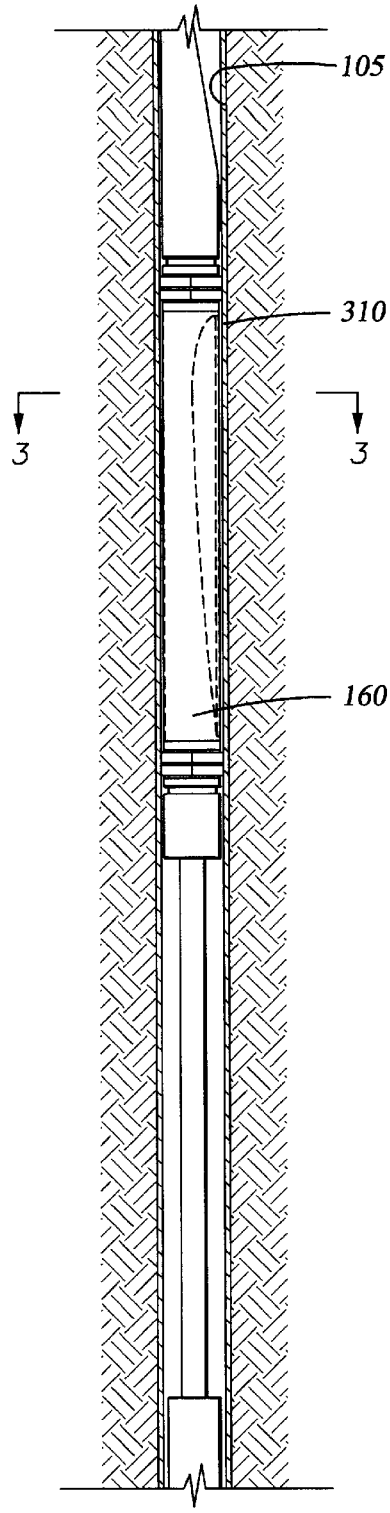
FIG. 2 is a view of the apparatus installed in a wellbore.
Figure 3:
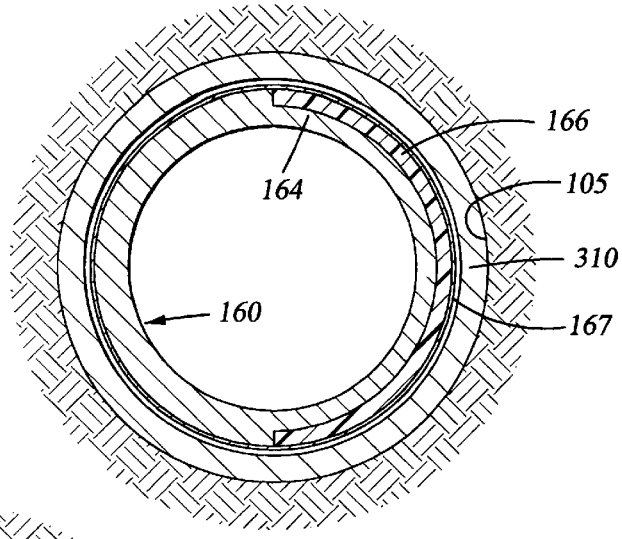
FIG. 3 is a top, section view of the container portion taken along a line 3—3 of FIG. 2.

FIG. 2 is a partial section view showing the apparatus 100 in a cased wellbore 105. Thermite material, shown in dotted lines, is located along a recessed outside wall of the container portion 160 adjacent that area of the casing 310 where a window will be formed. FIG. 3 is a top, section view taken along a line 3—3 of FIG. 2. Visible is the wellbore 105, the casing 310 and a wall 164 of the container portion 160. In the embodiment shown, the wall 164 of the container portion 160 is reduced in thickness on one side, creating a cavity 166 in the area adjacent the casing where the window will be formed. Thermite is housed in cavity 166 and is held at its outer surface by a thin sheet of mesh 167 wrapped therearound. It will be appreciated by those skilled in the art that the thermite material could be located and housed adjacent the casing wall in any number of ways so long as the proximity of the thermite to the casing permits the thermite process to effectively remove and displace or otherwise damage the casing material to form a window in the casing.

Figure 4:
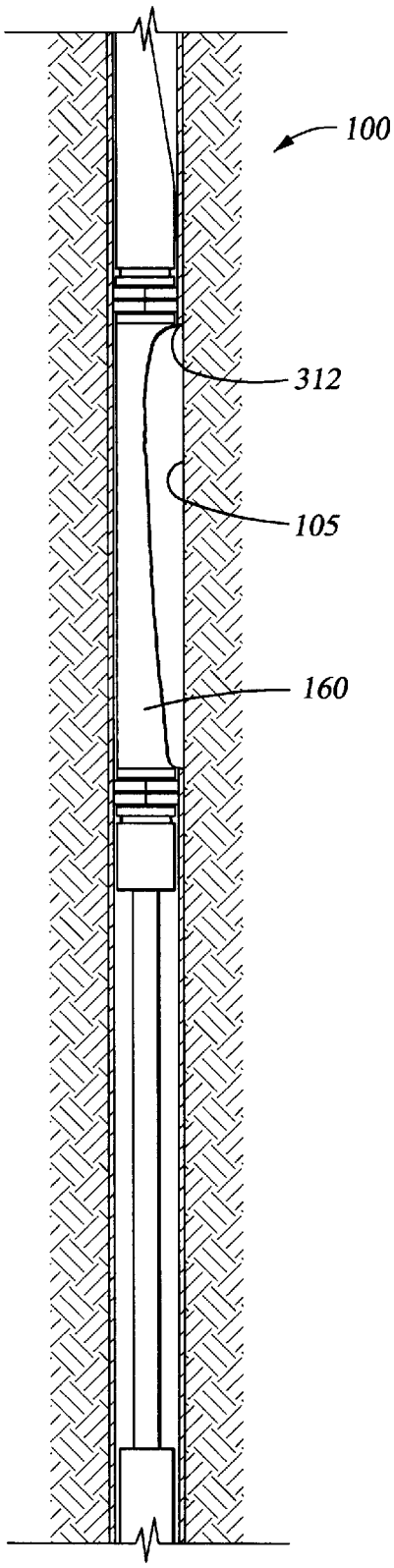
FIG. 4 is a section view of the apparatus after a window has been formed in the casing adjacent the container portion.
Figure 5:
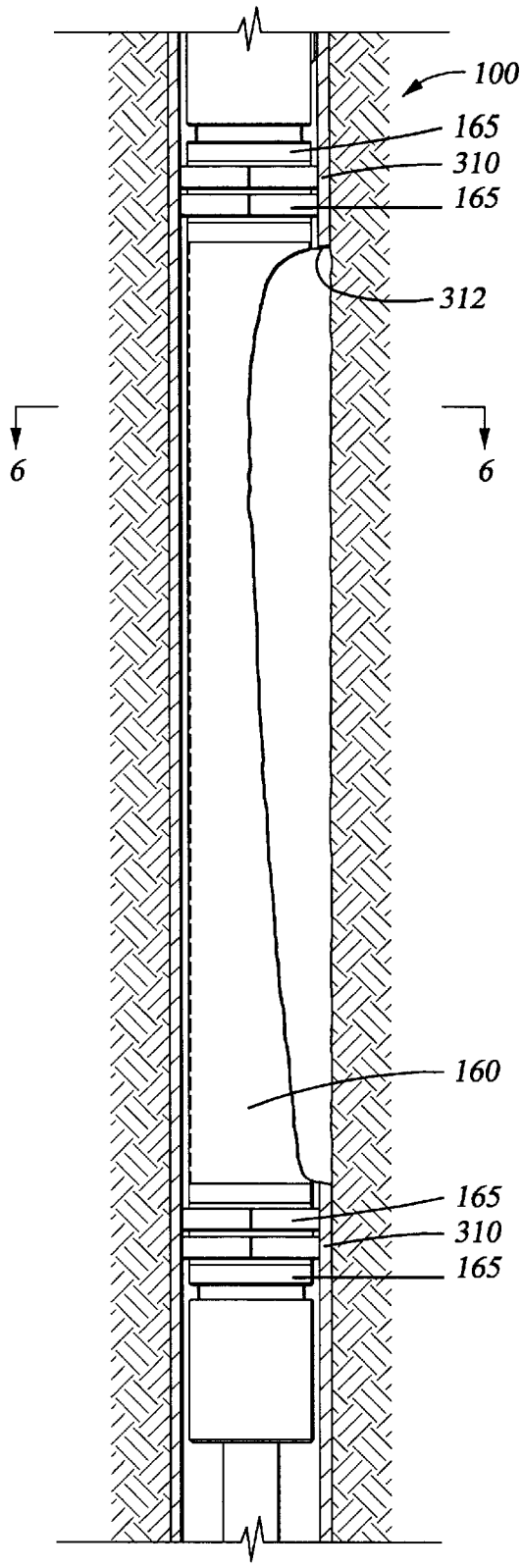
FIG. 5 is an enlarged view thereof.

FIG. 4 is a partial section view of the apparatus 100 in a wellbore 105 after a window 312 has been formed in the casing and FIG. 5 is an enlarged view thereof. As illustrated, casing 310 remains above and below the window 312. The shape of the window 312 is typically as depicted in FIG. 5, i.e., an elliptical shape adequate for drill bit 120 and drill stem 110 to pass through at a steep angle. At an upper and lower end of the container portion 160, split rings 165 are located and are designed to urge the casing material and thermite to flow into the bottom of the container portion 160 as it melts and also to remove any remaining material on the inside of the window opening as the container portion 160 moves down across the window 312 after the window is formed, as will be more fully disclosed herein.

Window 312 is formed through a thermite, process, including an exothermic reaction brought about by heating finely divided aluminum on a metal oxide, thereby causing the oxide to reduce. Thermite is a mixture of a metal oxide and a reducing agent. A commonly used thermite composition comprises a mixture of ferric oxide and aluminum powders. Upon ignition, typically by a magnesium ribbon or other fuse, the thermite reaches a temperature of 3,000° Fahrenheit, sufficient to soften steel and cause it to flow.

One alternative to causing the spent thermite and the casing material to flow into a container is to leave a solidified mass of casing material in a state that is very fracturable and brittle and will break easily into small pieces which can then flow up the drill string with the flow of drilling fluids. This can be accomplished by supplying an excess of oxygen to the molten metal during combustion such that a portion of it is converted to oxide. The excess oxygen could also be obtained by altering the ratios of constituents making up the thermite or from an additive. Two additives that could be used to provide this excess oxygen are copper oxide (CuO) and cellulose. By performing a thermite operation with such an addition of oxygen, the casing material can be virtually destroyed but left in place or reduced to some state where it is easily broken up. In this embodiment therefore, no container portion for containing spent thermite or casing material is necessary.

Figure 6:
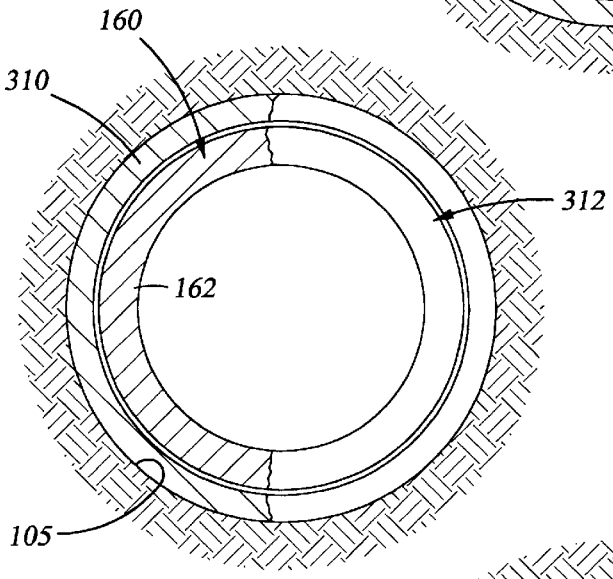
FIG. 6 is a section view of the container portion taken along a line 6—6 of FIG. 5 showing a section of the container wall and casing wall removed by exothermic means.

FIG. 6 is a top, section view taken along a line 6—6 of FIG. 5. Visible in FIG. 6 is the container portion 160 of the apparatus 100 after the window 312 has been formed in the wall of the casing 310. Visible on the left side of the Figure is casing 310 and disposed annularly therein, the undamaged wall 162 of the container portion 160. Visible on the right side of the drawing, the wall 162 of the container portion 160 and the casing 310 wall have been removed by the thermite process, leaving the interior of the container portion 160 exposed to the wellbore 105.

Figure 7:
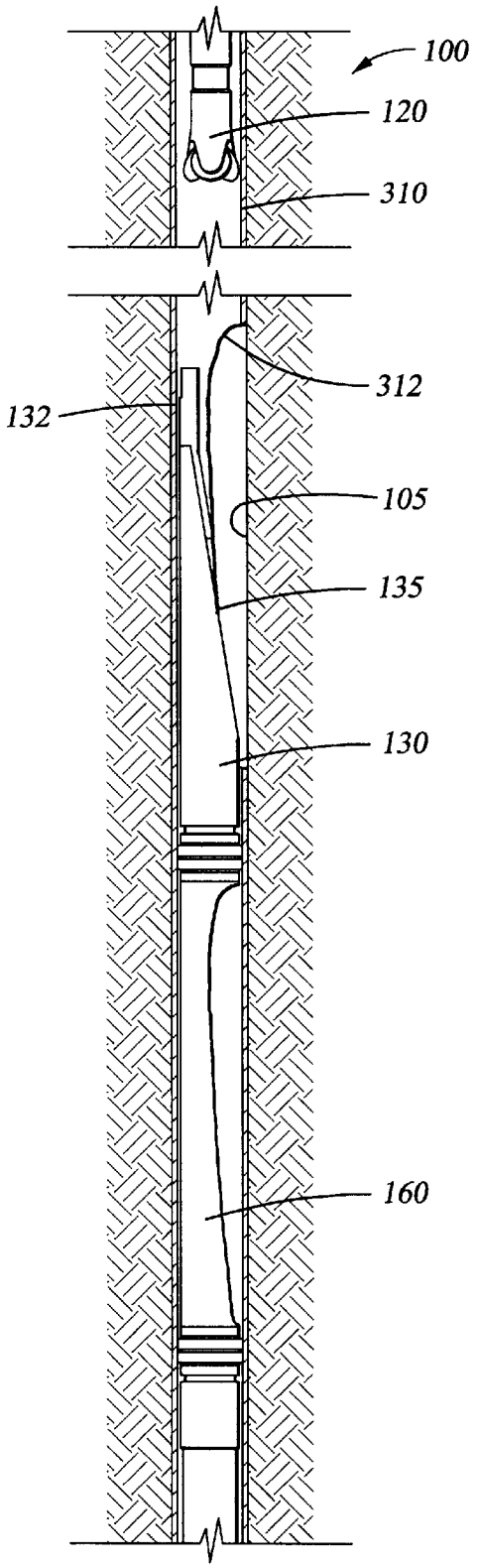
FIG. 7 is a section view of the apparatus illustrating the whipstock positioned adjacent the casing window after the telescopic joint has retracted and a shearable connection between the whipstock and a drill bit thereabove has failed.

FIG. 7 is an elevation view of the apparatus 100 illustrating the whipstock 130 in the wellbore 105 at a location adjacent the newly formed window 312 in the casing 310. As will be more fully described herein, the telescopic joint (not shown) has moved to its second, retracted position causing the shearable connection 132 between the drill bit 120 and the whipstock 130 to fail. In this manner, the container portion 160 and the whipstock 130 move to a position whereby the whipstock is adjacent the window 312. Visible also in FIG. 7 is the window left in the container wall by the thermite. From the position illustrated in FIG. 7, the formation of a lateral wellbore can begin with the rotating drill bit 120 moving down and along the sloped portion 135 of the whipstock 130, through the casing wall window 312 and into a formation adjacent thereto.

Figure 9:
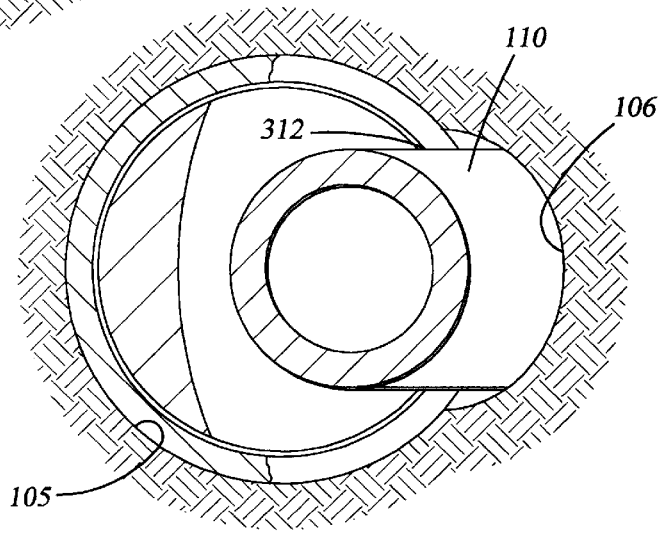
FIG. 9 is a top, section view of the whipstock and lateral wellbore taken along a line 9—9 of FIG. 8.
Figure 8:
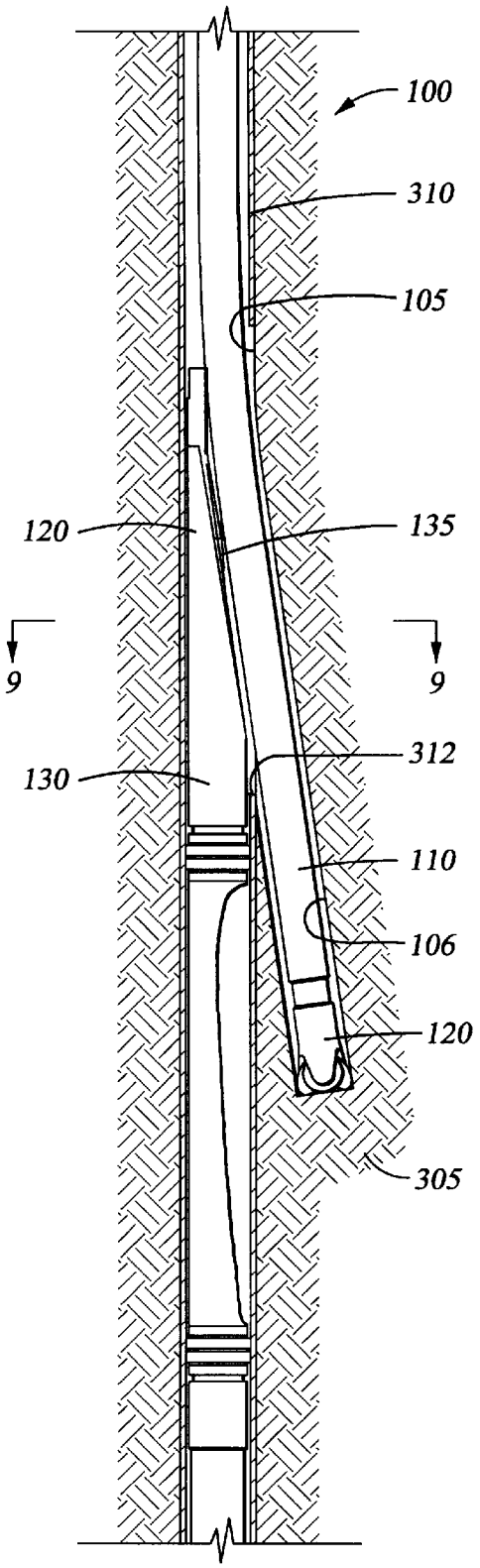
FIG. 8 is a section view showing the drill string and drill bit extending through the casing window to form the lateral wellbore in adjacent strata.

FIG. 8 is a partial section view illustrating the drill bit 120 and drill stem 110 having traveled down the sloped portion 135 of the whipstock 130, through the newly formed window 312 in the casing 310 and into formation 305 where the lateral wellbore 106 is formed. FIG. 9 is a section view taken along a line 9—9 of FIG. 8 and showing the drill stem 110 having exited the central wellbore 105 through window 312 to form the lateral wellbore 106.

Figure 10:
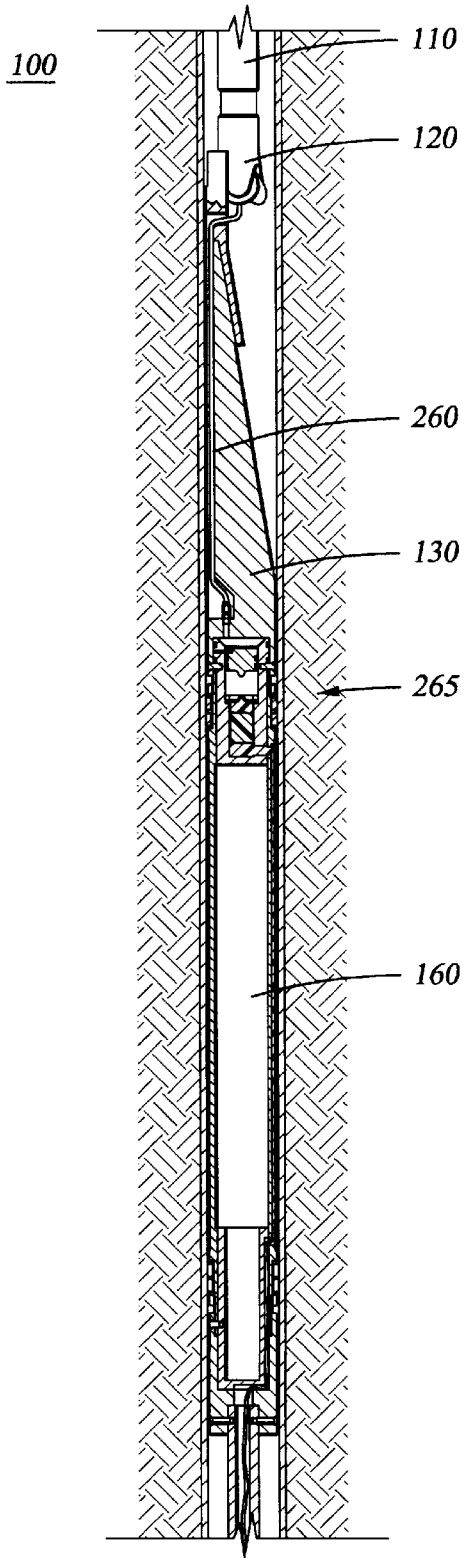
FIG. 10 is a section view of the apparatus illustrating a thermite initiator assembly disposed between the whipstock and container portion.
Figure 11:
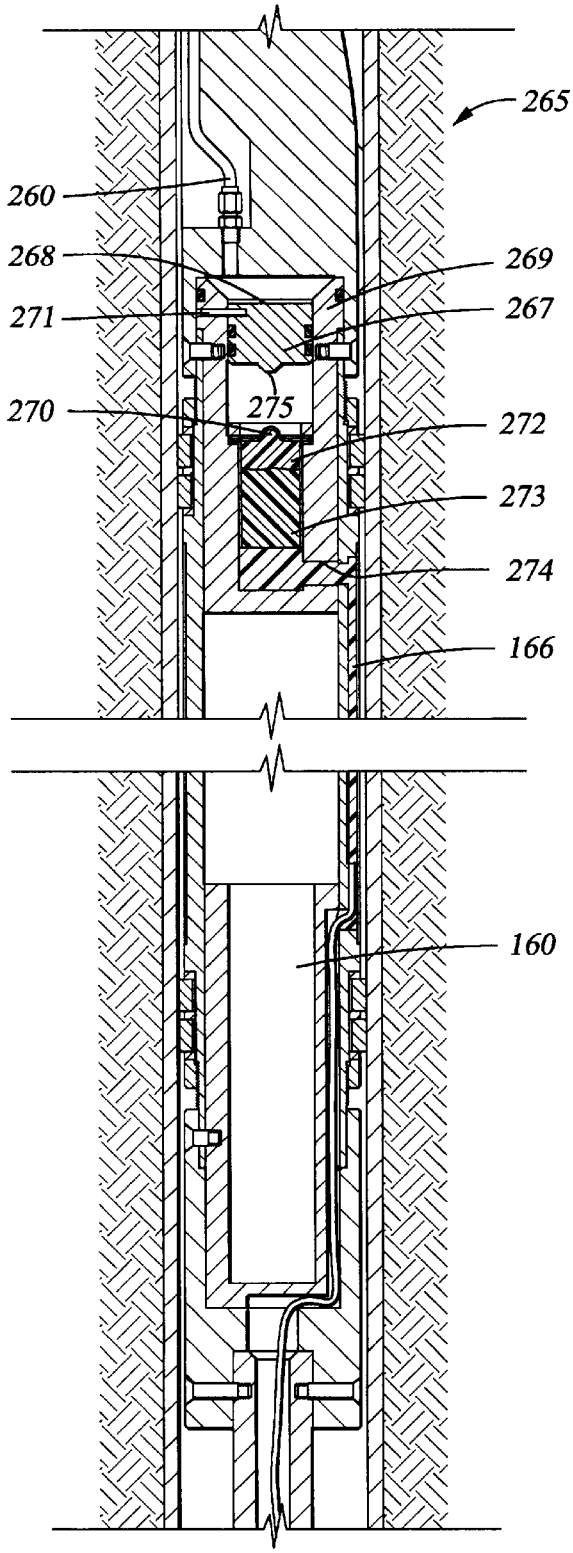
FIG. 11 is an enlarged view thereof.

In one embodiment, the thermite reaction is initiated by a fluid power signal provided from the surface of the well through drill stem 110 and a hydraulic line extending from an aperture formed in the drill bit 120 to a thermite initiator assembly therebelow. FIG. 10 is an elevation view, partially in section, of the assembly 100 showing the hydraulic line 260 extending from the drill bit 120 to the thermite initiator assembly 265 located between the lower portion of the whipstock 130 and the upper container portion 160. An aperture through drill bit 120 provides fluid communication between the drill stem 110 and the thermite initiator assembly 265 via the hydraulic line 260. FIG. 11 is an enlarged section view of the thermite initiator assembly 265. The initiator assembly 265 includes an initiator piston 267 housed in a body 269 and a primer 270 disposed therebelow to start the thermite reaction upon contact with the initiator piston 267. The hydraulic line 260 is in fluid communication with a piston surface 268 through a port thereabove and the initiator piston 267 is fixed in a first position within the body 269 with at least one shear pin 271 designed to fail when a predetermined pressure is applied to the piston surface 268 via the hydraulic line 260. Disposed below the primer 270 is a first fire mix 272 and therebelow a quantity of loose thermite powder 273. Extending from the area of the loose thermite powder 273 through a bore 274 in the wall of the container portion 160 is a quantity of packed thermite which leads directly to thermite arranged in the cavity 166 formed in the container portion wall adjacent the casing wall as is illustrated in FIG. 3. When a predetermined pressure is applied to piston surface 268 and the shear pin 271 fails, the piston 267 travels down the stroke of the body 269 and a formation 275 in the center of a lower surface of the piston 267 contacts primer 270 which then ignites the first fire mix 272 and the loose thermite powder 273 therebelow. Subsequently, the thermite located in cavity 166 is ignited.

Figure 12:
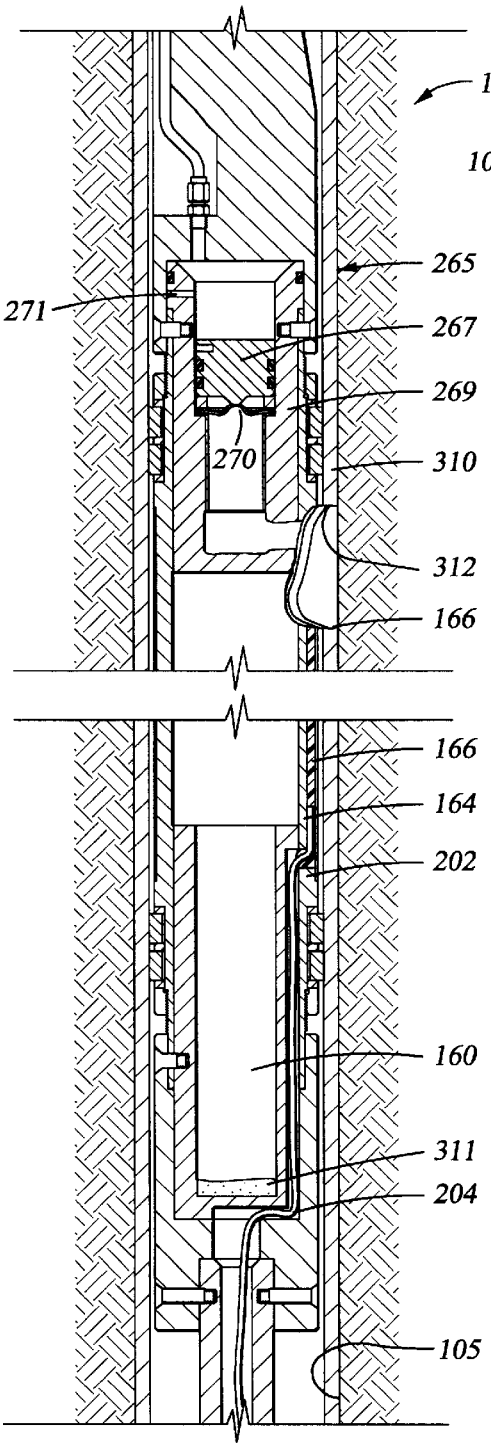
FIG. 12 is a section view showing a partially formed window in the wellbore casing.
Figure 13:
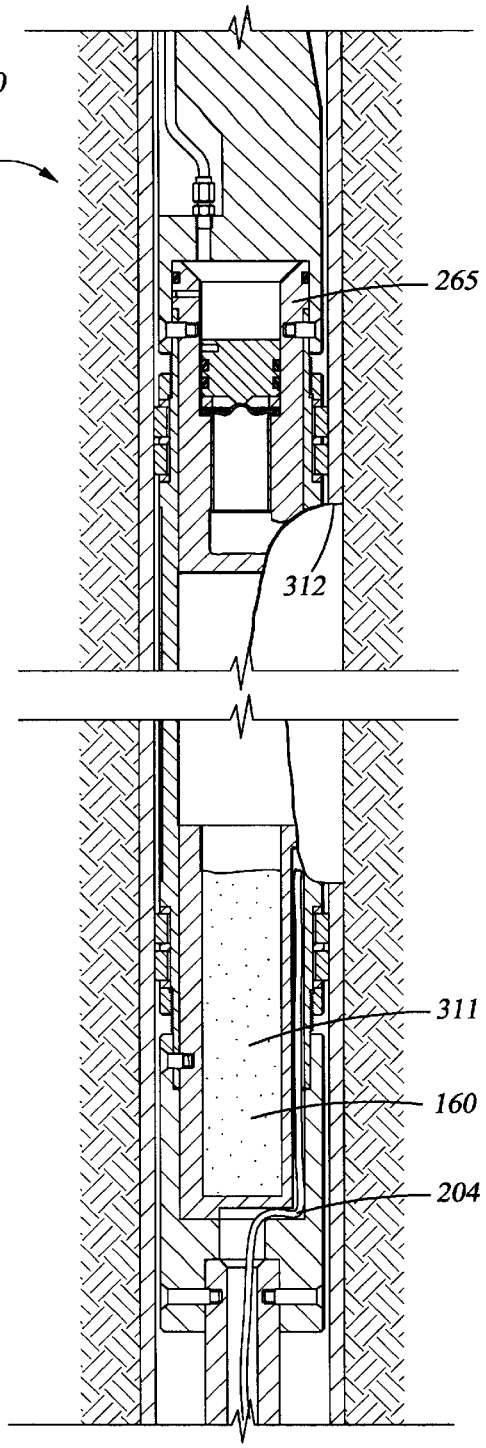
FIG. 13 is a section view showing a fully formed window in the wellbore casing.

FIG. 12 is a section view of the apparatus 100 in wellbore 105, after the piston 267 has traveled downwards in body 269 and contacted primer 270 to begin the thermite process. A partially formed window 312 is visible in the Figure. As the thermite located in the cavity 166 begins burning in a top-down fashion, the material making up the casing 310 and that portion of container wall 164 adjacent cavity 166 is softened and through the action of time and heat is loosened sufficiently to flow to the bottom of the container portion 160 along with spent thermite material. The material 311 is visible housed in the bottom of the container portion 160. In this manner, the casing is removed and window 312 is formed, leaving an opening in the casing 310 adequate for drill bit 120 and drill stem 110 to pass through. Specifically illustrated in FIG. 12 is the top down formation of the window 312 as the thermite located in cavity 166 burns from its point of ignition at the thermite initiator assembly 265 towards the lower end of the container portion 160 to form a substantially elliptical shape in the casing 310. As the casing material is heated and melted, it flows into the bottom of the container portion and away from the newly formed window 312 and the wellbore 105. FIG. 13 is a section view showing the completely formed window 312. In this view, the thermite reaction has moved from the upper end of the container portion to a lower end, forming window 312, the shape of which is determined by the shape of the thermite packed into the cavity 166 of the container portion 160.

Also visible in FIGS. 12 and 13 is a means for causing the telescopic joint 200 (not shown) to move to its second position as the formation of window 312 is completed. A channel 202 formed in a lower wall of the container portion 160 leading from the lower end of the window 312 is constructed and arranged to house a fuse 204 or strip of thermite that will ignite as the formation of the window 312 is completed, carrying a burning charge to a lower area of the container portion 160. The purpose of the thermite fuse 204 is to initiate the actuation of the telescopic joint 200, causing the joint 200 to move from the first or extended position to the section or retracted position.

Figure 14:
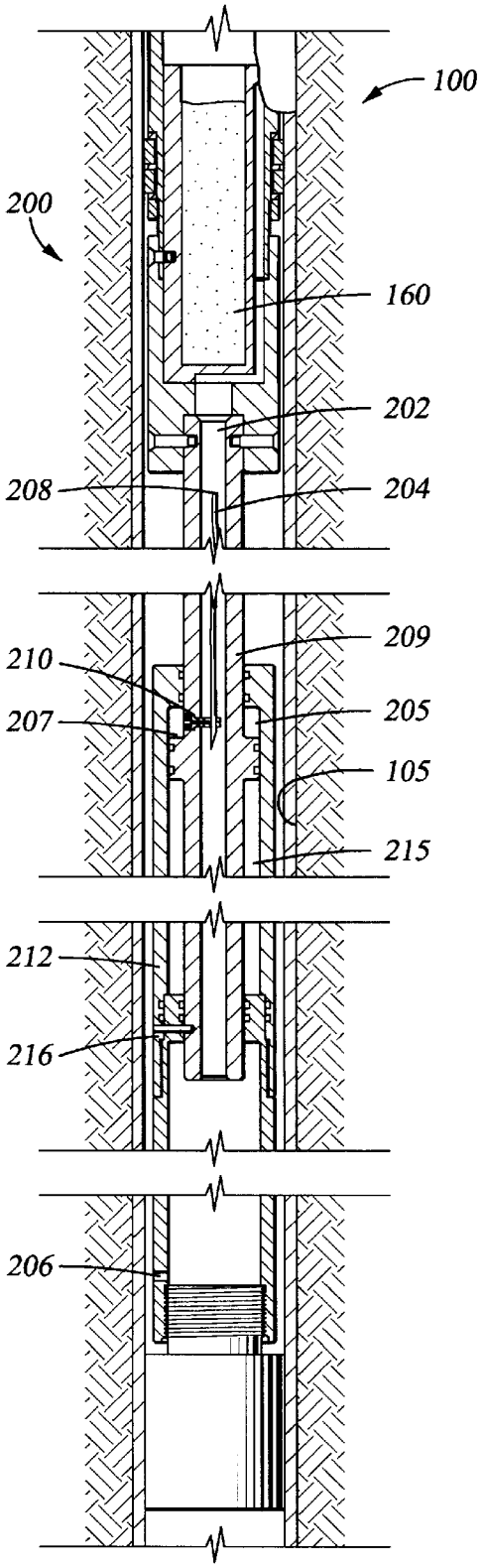
FIG. 14 is a section view of the telescopic joint in its first or extended position.

FIG. 14 is a section view illustrating the path of the fuse 204 from the bottom portion of the container portion 160 of the apparatus 100 to the telescopic joint 200 therebelow in the wellbore 105. Thermite fuse 204 extends through a channel 202 formed in a central shaft 209 of the telescopic joint 200 and terminates at a break plug 210 which is designed to be fractured by the burning thermite fuse 204. In FIG. 14, the fuse 204 is shown partially burned and terminates at a point 208 in channel 202. The telescopic joint 200 is constructed and arranged with an upper atmospheric chamber 205 and lower atmospheric chamber 215, both of which are formed between the exterior of the shaft 209 and an interior of a lower portion 212 of the telescopic joint 200. Both atmospheric chambers 205, 215 are initially at atmospheric or surface pressure. When the break plug 210, located in the upper atmospheric chamber 205 is fractured, the upper atmospheric chamber 205 is exposed to wellbore pressure. Wellbore pressure enters the interior of the channel 202 from a port 206 located in the bottom portion of the telescopic joint 200. Fluid entering the port from the wellbore extends upwards in the telescopic joint 200 through channel 202 and enters the upper atmospheric chamber 205. Thereafter, the higher pressure wellbore fluid acts upon a piston surface 207 in chamber 205 urging the piston downwards due to the pressure differential between the two chambers 205, 215. A shear pin 216 keeps the telescopic joint 200 in its first position during run-in of the apparatus but is designed to fail upon a predetermined amount of pressure exerted on the piston surface 207 in the atmospheric chamber 205.

Figure 15:
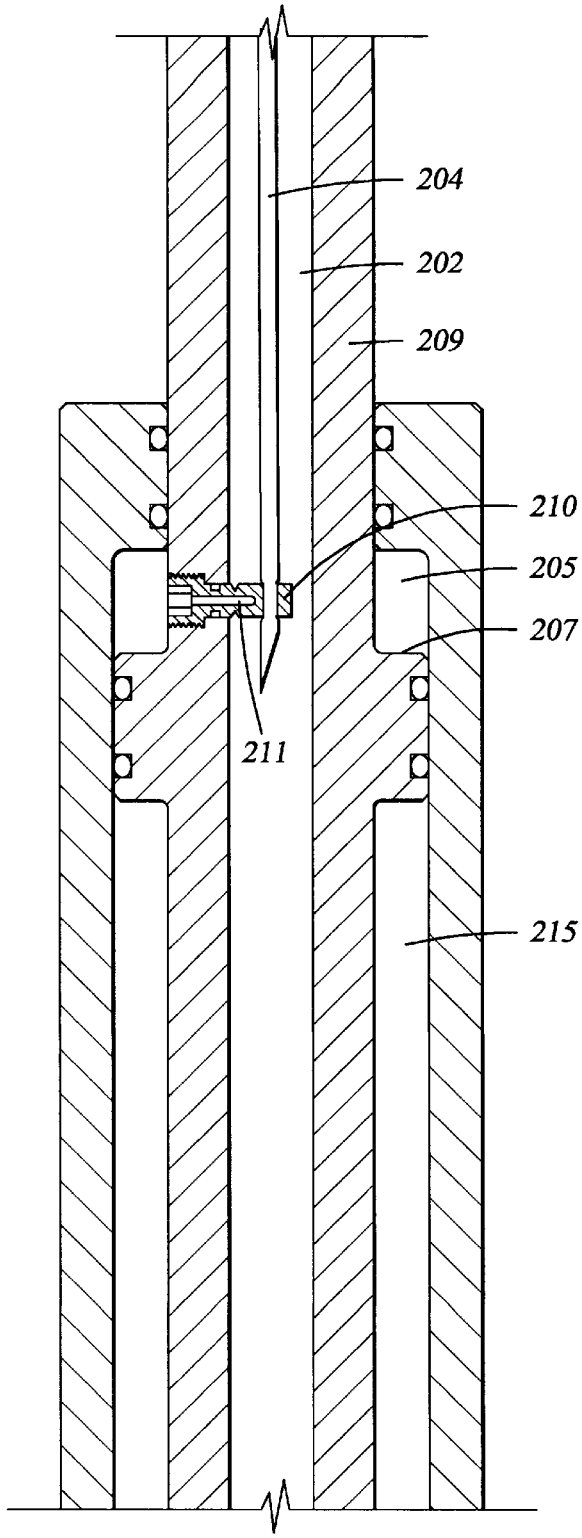
FIG. 15 is a section view of the telescopic joint showing a thermite-actuated break plug in greater detail.
Figure 16:
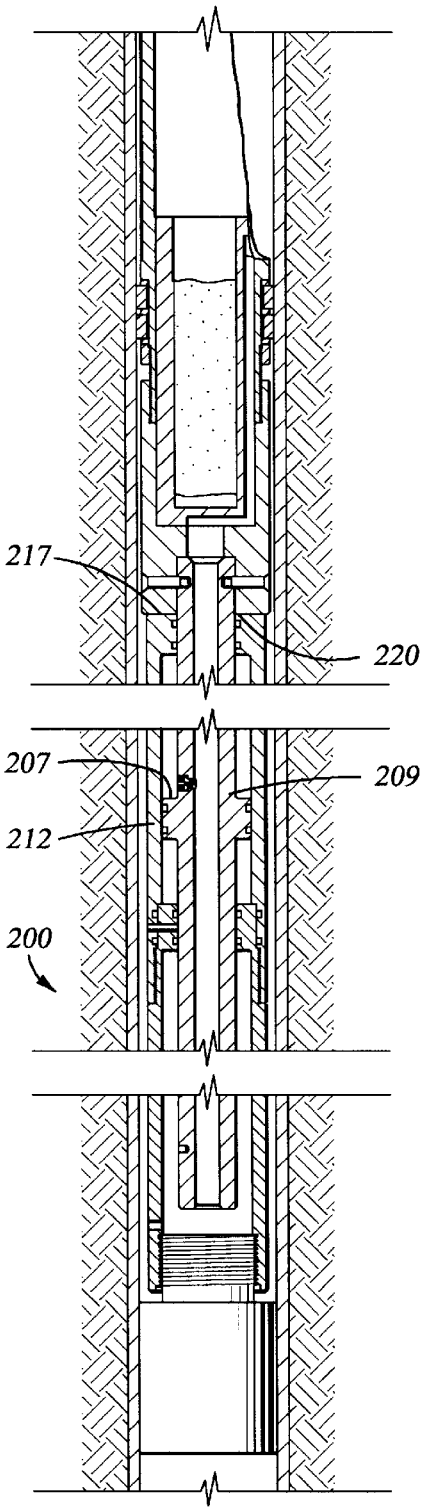
FIG. 16 is a section view of the telescopic joint in the second or retracted position.

FIG. 15 is an enlarged view illustrating the break plug 210 disposed in channel 202 of the telescopic joint 200 and providing a selectable fluid communication between fluid in the channel 202 and the upper atmospheric chamber 205 of the telescopic joint 200. The plug 210 includes a passageway 211 therethrough to expose the atmospheric chamber 205 to the pressure in the interior of the telescopic joint upon fracturing of the break plug. FIG. 15 also illustrates the thermite fuse 204, which extends into contact with the break plug 210. FIG. 16 is a section view of the telescopic joint 200 shown in its retracted or second position. As is visible in the Figure, wellbore pressure has urged the central shaft 209 of the telescopic joint 200 to a lower position relative to the lower portion 212 of the joint, terminating in contact between an upper shoulder 217 of the telescopic joint 200 and the bottom 220 of the container portion 160 of the assembly. As the telescopic joint moves from the first to the second position, the shearable connection 132 between the drill bit 120 and the whipstock 130 fails allowing the container portion 160 of the assembly and the whipstock 130 to move to a lower, predetermined position within the wellbore (FIG. 7) whereby the sloped portion 135 of the whipstock 130 is accurately positioned in front of the newly formed window 312 in the casing 310.

In operation, the apparatus 100 of the present invention operates as follow: The assembly 100, including the drill stem 110, drill bit 120, whipstock 130 container portion 160, telescopic joint 200 and anchor 280 are run into a wellbore 105 to a predetermined location where the anchor 280 is set, fixing the assembly 100 in the interior of the wellbore. A measurement-while-drilling (MWD) device may be used to properly orient the apparatus within the wellbore. Thereafter, using a hydraulic signal means via hydraulic line 260 running from the drill bit 120 to the thermite initiator assembly 265, the thermite located in the wall of the container portion 160 is ignited and through heat and time, a window 312 is formed in the casing 310 adjacent the wall of the container 160. As the thermite completes its burning, a thermite fuse 204 adjacent a lower end of the window 312 ignites and subsequently causes a break plug 210 located in the telescopic joint 200 to fail, thereby exposing a piston surface 207 formed in an atmospheric chamber 205 to wellbore pressure. Wellbore pressure, acting upon the piston surface 207 is adequate to cause a shearable connection 132 between the drill bit 120 and the whipstock 130 to fail and the entire assembly below the drill bit 120 moves to a second, predetermined position as the telescopic joint 200 assumes its second position. Thereafter, the whipstock 130 is properly positioned in the wellbore 105 adjacent the newly formed window 312 in the casing 310 and the drill stem 110 and drill bit 120 can be lowered, rotated and extended along the sloped portion 135 of the whipstock and through the window 312 to form a lateral wellbore.

Figure 17:
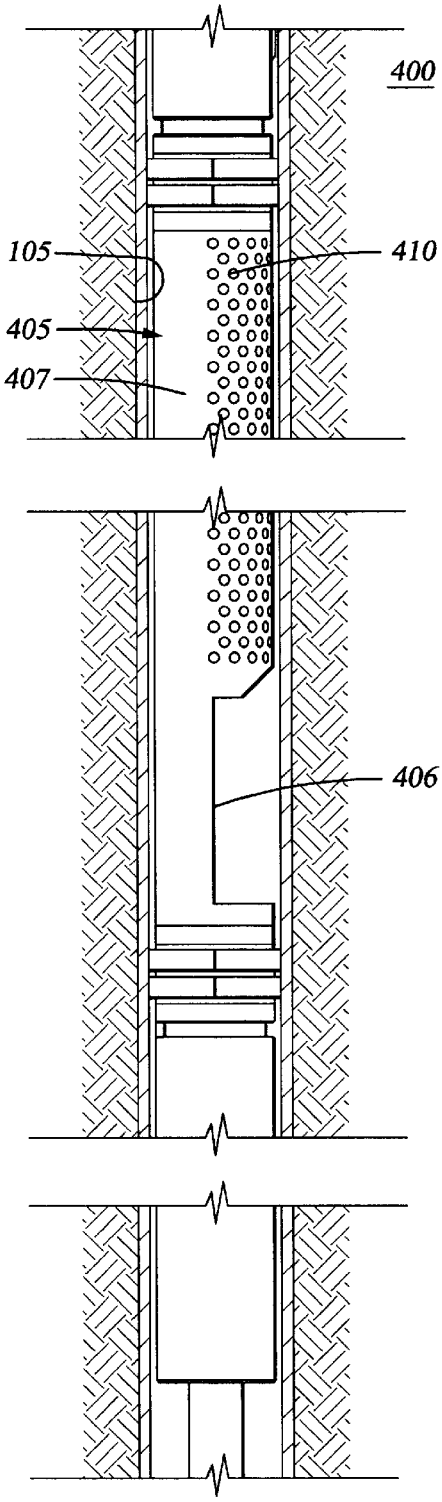
FIG. 17 is an alternative embodiment of the invention illustrating a container portion with apertures formed in a wall thereof.
Figure 18:
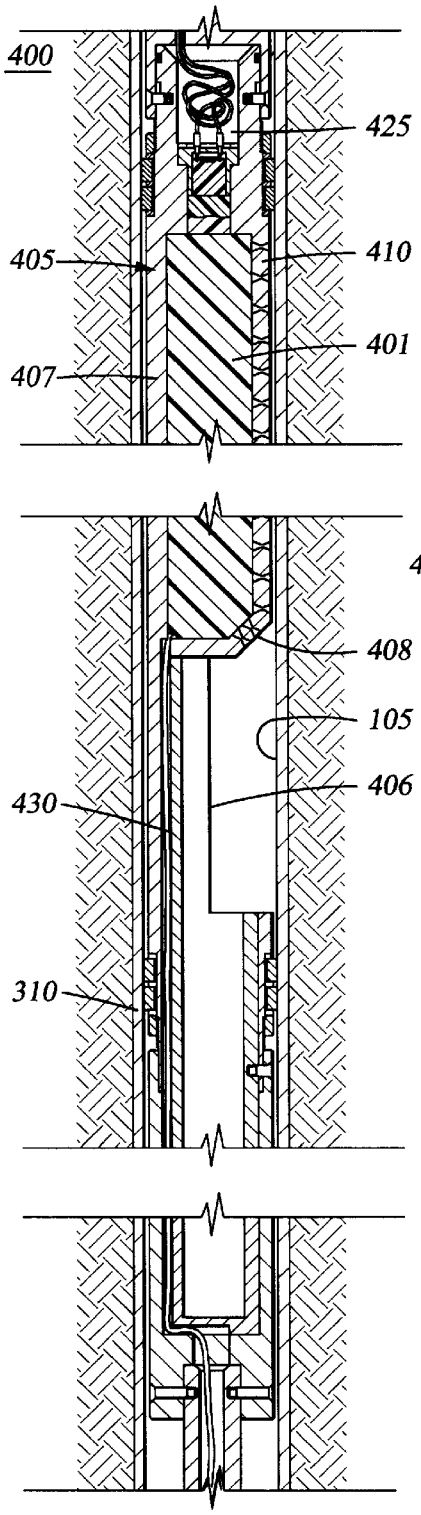
FIG. 18 is a section view thereof.

FIG. 17 is a plan view of an apparatus 400 in a wellbore 105 and illustrates an alternative embodiment of the invention wherein a container portion 405 of the apparatus includes a wall 407 having aperture 410 therethrough. In this embodiment, the thermite material, located inside the container portion, causes destruction of the adjacent wellbore casing without destroying the wall of the container. The wall 407 of the container 405 is formed of ceramic material or some other material resistant to the heat created by the burning thermite. As shown in FIG. 17, the container portion 405 of the apparatus in this embodiment is extended in length to include a lower portion having an opening 406 constructed and arranged to receive spent thermite and casing material as the thermite process is completed and a window is formed in the casing. FIG. 18 is a section view showing the thermite material 401 in the interior of the container portion 405 as well as the shape of the apertures 410 formed in the container wall. Each aperture includes a converge/diverge portion whereby during the thermite process, burning thermite is directed through each aperture where the velocity of the thermite increases in the converge portion. A diverge portion at the outer opening of each aperture allows the burning thermite to exit the container wall 407 in a spray fashion giving a sheet effect to the burning thermite as it contacts and melts the casing 310. A lower portion container portion wall 407 includes a slanted face 408 also having apertures 410 formed therein. The shape of the slanted face 408 permits a pathway for flowing thermite and casing material into the opening 406 therebelow. Also visible in FIG. 18 is a thermite initiator assembly 425 relying upon an electrical signal to begin the thermite process (FIG. 19) and a thermite fuse 430 extending from the bottom of the container portion wall 407, below the aperture 400 to a telescopic joint 200 (not visible) therebelow.

Figure 19:
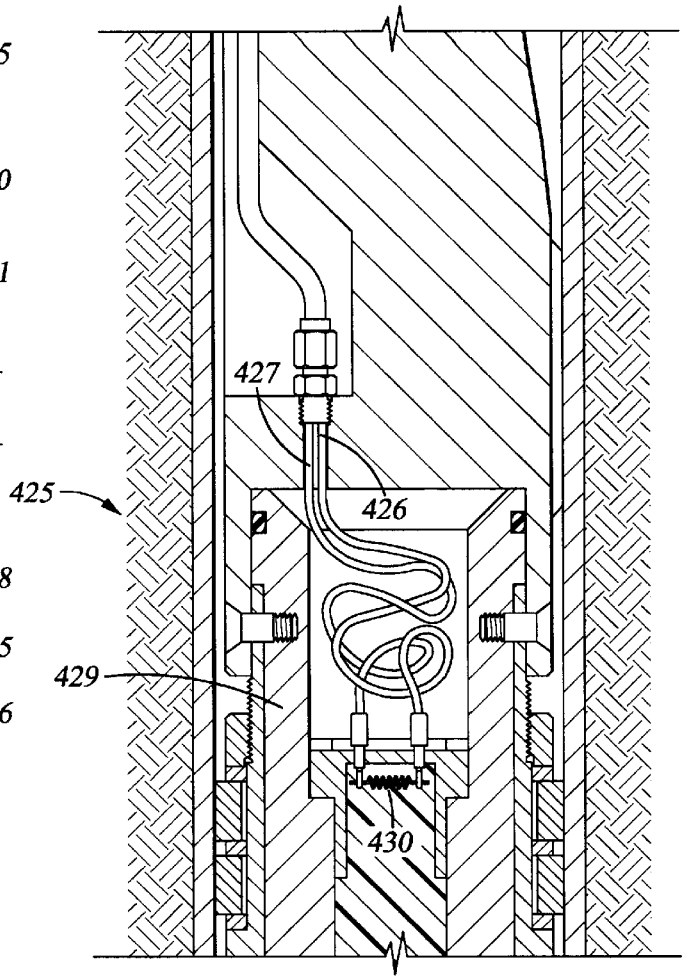
FIG. 19 is a section view illustrating an alternative means of initiating the thermite process.

FIG. 19 is a section view of an electrical assembly 425 for initiating the thermite process. The assembly 425 includes two electrical conductors, 426, 427 extending from the surface of the well and attached to an electrode 430 therebetween in a housing 429 of the thermite initiator 425. At a predetermined time, an electrical signal is supplied from the surface of the well and the electrode 430 rises to a temperature adequate to initiate burning of thermite located proximate the electrode. Subsequently the thermite in the wall of a container portion burns to form the window in the casing.

Figure 20:
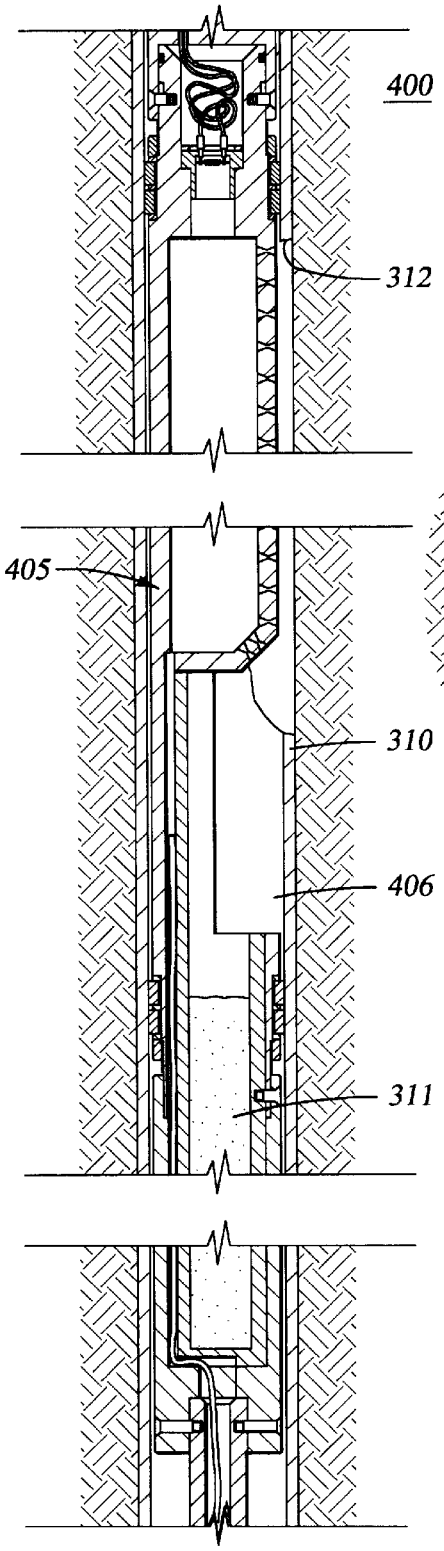
FIG. 20 is a section view showing a window formed in casing.

FIG. 20 is a section view of the apparatus 400 after the window 312 in the casing 310 has been formed but before the telescopic joint 200 therebelow (not shown) has caused the whipstock 130 thereabove (not shown) to move adjacent the window 312. Visible specifically is thermite and casing material 311 which has flowed into the opening 406 in the lower portion of container portion 405. While a portion of the container wall is constructed of ceramic in the preferred embodiment, it will be understood that this embodiment of the invention could be constructed in a number of ways and the ceramic portion of the wall could consist only of inserts inserted in a metallic wall, with each insert including an aperture formed therein.

Figure 21:
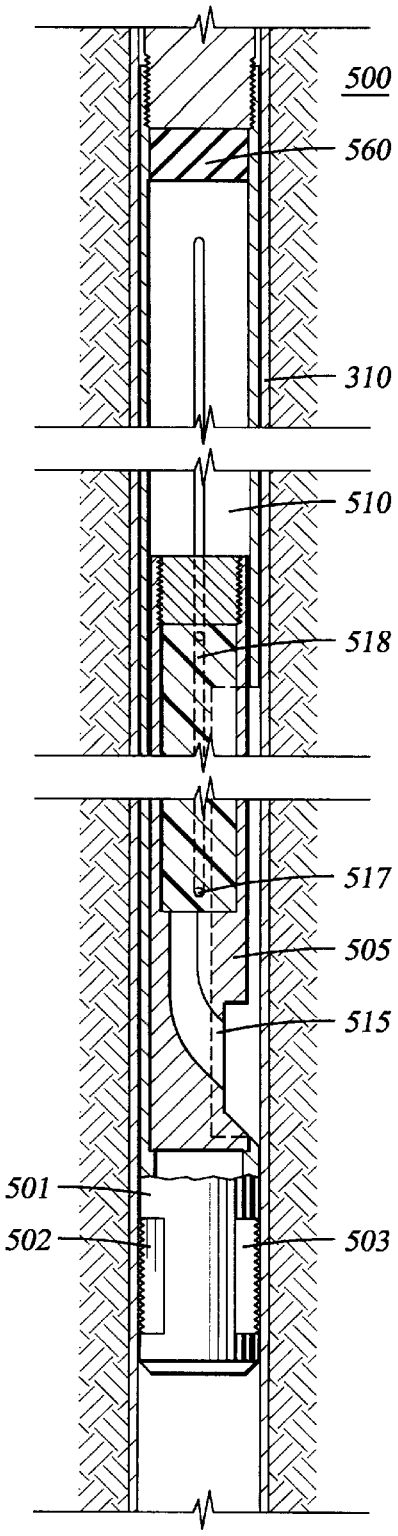
FIG. 21 is yet another embodiment of the invention illustrating a rocket member slidably disposed in a cased wellbore.

FIG. 21 illustrates yet another embodiment of the invention whereby a window in casing 310 is created by combustion of fuel in a rocket member 505 disposed in a container portion 510 of the apparatus 500. In this embodiment of the invention, a window is formed by the combustion of solid fuel material, like thermite in the rocket member 505. The products of the combustion are directed towards the casing wall by a slanted nozzle 515 as the rocket member 505 is propelled upwards in the container portion 510 of the apparatus 500. Specifically, the rocket member with its slanted nozzle 515 is disposed in a lower area of the container 510 whereby the nozzle 515 is adjacent an area of the casing 310 where the bottom of the casing window will be formed. In the preferred embodiment, the rocket member is slidably disposed in the container portion 510 with a pin and slot arrangement whereby at least one pin 517 formed on the body of the rocket member is retained and moves within at least one slot 518 formed within the interior of the container portion 510. During the thermite process, when the rocket member is expending fuel through the slanted nozzle 515, the rocket member will be propelled upwards in the container portion 510 of the apparatus 500. Visible also in FIG. 21 is a dampening member 560 disposed in an upper area of the container portion 510 whereby the rocket member 505, upon reaching the upper area of the container will be slowed and stopped by the dampening member 560. The dampening member 560 is located at that vertical position in the container portion whereby the nozzle 515 of the rocket member will be adjacent the upper portion of a window when the dampening member 560 stops the upward momentum of the rocket member 505.

Figure 23:
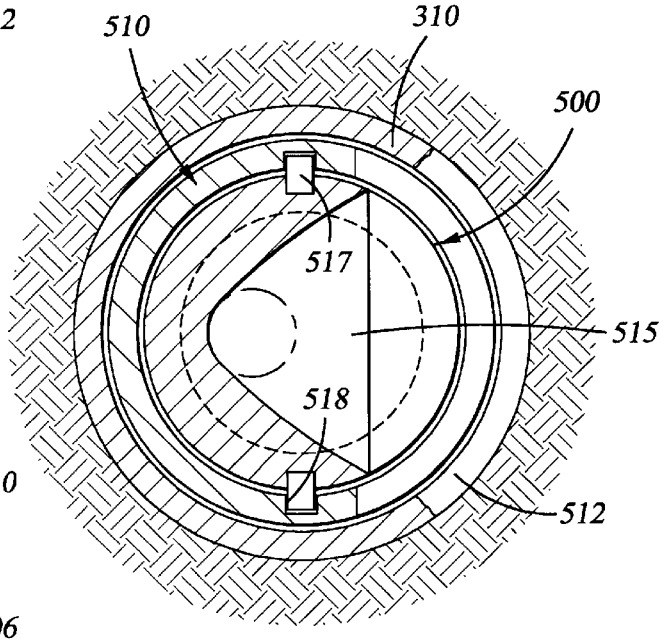
FIG. 23 is a top section view of the embodiment of FIG. 21.
Figure 22:
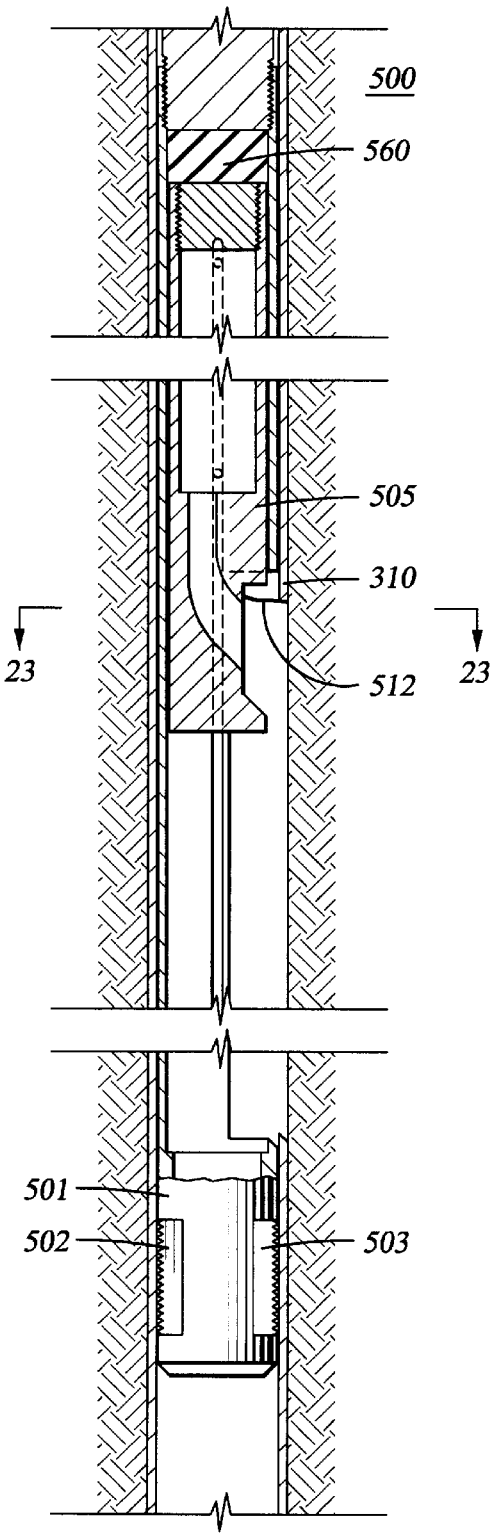
FIG. 22 is a section view of the apparatus of FIG. 21 illustrating the rocket member in a second, higher position within the apparatus.

FIG. 22 is a section view of the apparatus 500 depicting the rocket member 505 having moved to an upper portion of the container 510 and a window 512 having been formed in the casing 310 by the rocket member fuel. The top of the rocket member has contacted dampening member 560. In the embodiment shown, the apparatus includes a slip assembly 501 including two slip members 502, 503 that can be remotely actuated to fix the apparatus 500 in the wellbore. However, the apparatus could include a telescopic member therebelow and a thermite fuse with or without a time delay member can be located in a position whereby the fuse will begin burning as the formation of the window 512 is near completion. As with the other embodiments, the burning fuse initiates actuation of a telescopic joint therebelow, causing a whipstock to move into a position adjacent the newly formed window. FIG. 23 is a top section view taken along a lines 23—23 of FIG. 21. FIG. 23 illustrates the relationship between the jet member with its two pins 517 and the slots 518 formed in the inner wall of the container portion 510 of the apparatus 500.

Figure 24:
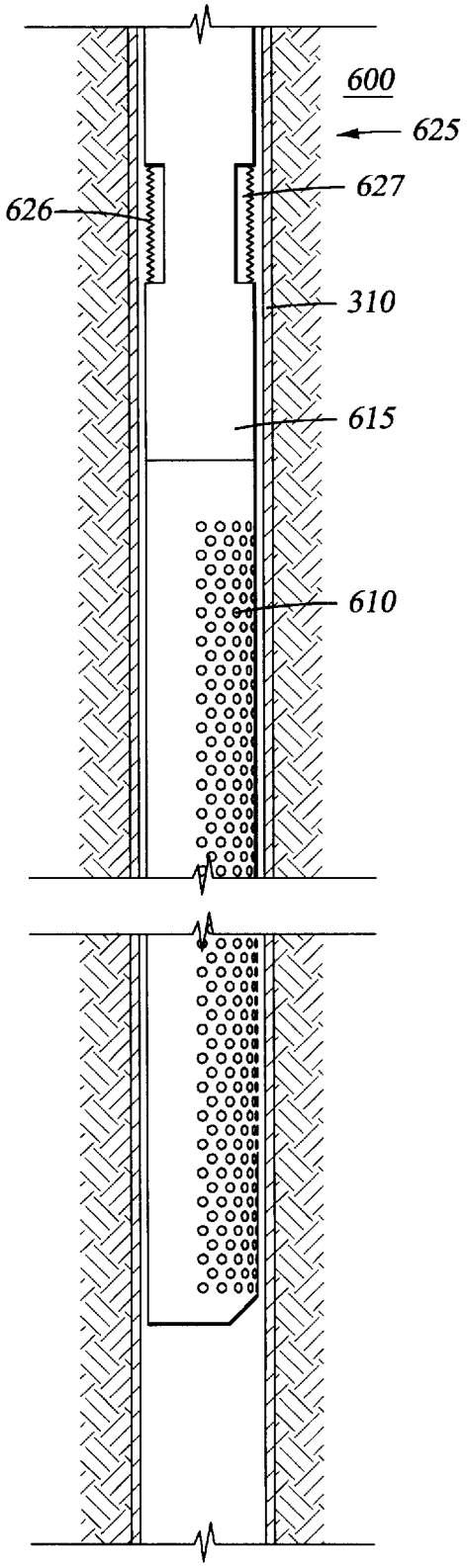
FIG. 24 is an elevation view of an alternative embodiment of the invention illustrating an apparatus with container portion having apertures formed in a wall thereof and a slip assembly disposed thereabove.
Figure 25:
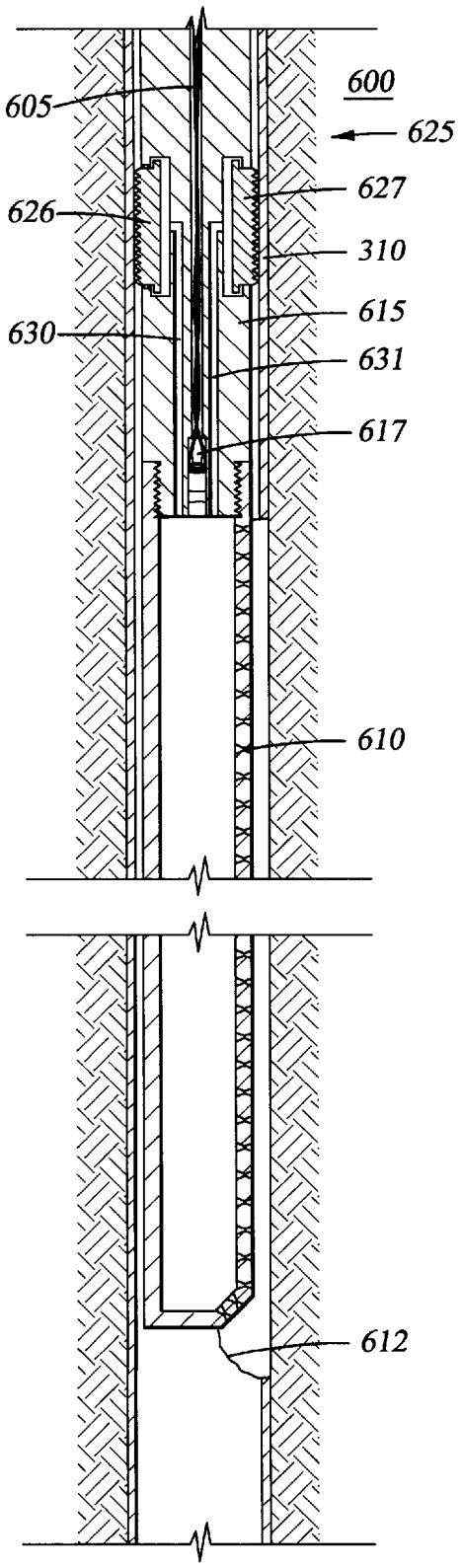
FIG. 25 is a section view of the apparatus after a window has been formed in casing.

FIG. 24 is an elevation view of an alternative embodiment of the invention providing a simple method and apparatus 600 for forming a window in downhole casing 310. The apparatus includes a container portion 615 having apertures formed therein and a slip assembly 625 for fixing the apparatus in a wellbore. FIG. 25 is a section view of the embodiment of FIG. 24 after a window 612 has been formed in adjacent casing 310. In this embodiment, the apparatus 600 containing thermite material is extended into the wellbore on wireline 605 to a predetermined position adjacent the area of the casing where the window will be formed. The container 615 has a predetermined amount of thermite disposed therein which is preferably disposed against a side of the container 615. The container is preferably formed of ceramic material having a plurality of apertures 610 formed therein. The apertures are arranged as those of the embodiment described in FIGS. 17, 18 and 20 herein. Wireline 605 is capable of carrying the weight of the thermite container and also capable of passing an electrical charge sufficient to begin the thermite process through the use of a thermite initiator 617 disposed at an upper portion of the thermite container. Thermite initiator 617 is similar to the device described in relation to FIG. 19 herein.

In order to rotationally and axially fix the container 615 in the predetermined area of the wellbore 105, slip assembly 625 is run into the wellbore 105 on wireline 605 along with the container 615. In the preferred embodiment, the. slip assembly 625 is disposed above the container and includes at least two slips 626, 627 which can be urged against the inside of the casing 310, preferably by some gas means made possible by the burning thermite, thereby holding the apparatus 600 in place in the wellbore while the thermite process forms the window 612 in the casing 310. In the preferred embodiment, the slip assembly 625 is gas actuated. Gas generated during the thermite process is communicated to the slip assembly 625 via channels 630, 631 connecting the slip assembly 625 to the container 615. In the preferred embodiment, the slip assembly is constructed and arranged to become actuated simultaneously with the commencement of the thermite process.

Figure 26:
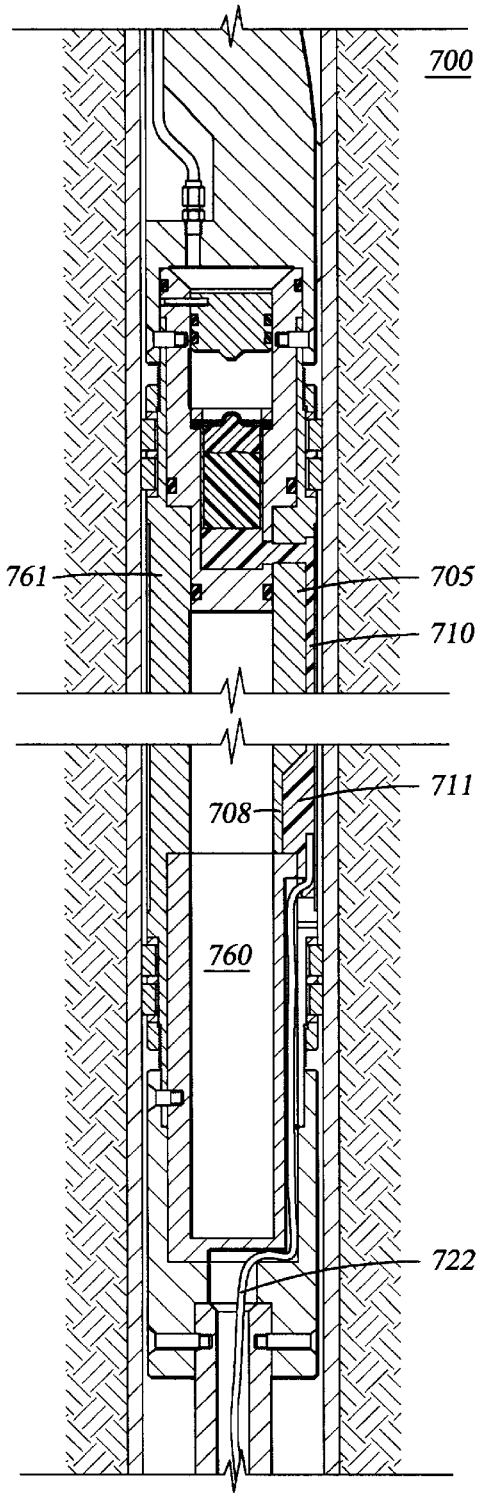
FIG. 26 is an alternative embodiment of the invention whereby the container portion forms an atmospheric chamber.
Figure 27:
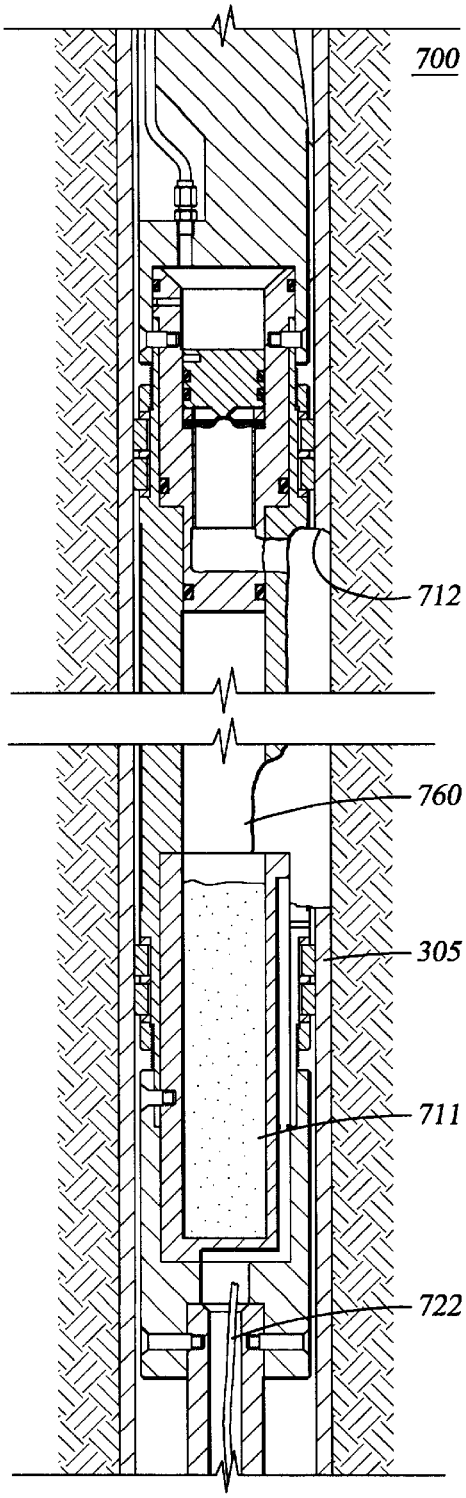
FIG. 27 is a section view of the embodiment of FIG. 26 after a window has been formed in the casing.

FIG. 26 is a section view of an alternative embodiment of the invention whereby a container portion 760 of an apparatus 700 forms an atmospheric chamber which, when exposed to wellbore pressure, urges spent thermite and casing material into a lower area 761 of the container 760. As with other atmospheric chambers, the pressure differential between the inside of the container portion and the wellbore create a suction when the interior of the container is breached and exposed to the wellbore pressure therearound. In this embodiment, a wall of the container portion adjacent the area of casing where a window will be formed includes an upper, thicker section 705 and a lower, thinner center section 708. Corresponding to the thickness of the container wall is the cavity formed between the container wall and the casing which, when filled with thermite, results in a layer of thermite having an upper, thinner portion 710 and a lower, thicker portion 711. The design of the present embodiment permits the thermite to burn in a top-down fashion melting the casing material without breaching the wall of the container 760. As the burning thermite reaches the thinner wall section 708, the thicker layer of thermite causes the wall section to melt, thereby exposing the atmospheric chamber in the interior of the container portion to wellbore pressure. The result is a suction which acts to urge spent thermite and casting material into the container portion. FIG. 27 is a section view of the embodiment FIG. 26 showing a window 712 having been formed in casing 305.

Visible specifically in this view is the lower portion of the container which has been filled with spent thermite and casing material 711. A fuse 722 running from the lower portion of the window to the telescopic joint assembly therebelow is partially burned.

While foregoing is directed to some embodiments of the present invention, other and further embodiments of the invention may be devised without departing from the basic scope thereof, and the scope thereof is determined by the claims that follow.

What is claimed is:

1. An apparatus for forming a window in the wall of a tubular in a wellbore, comprising:

a container portion, the container portion defining an interior space therein and having an array of apertures arranged in at least two planes;

an exothermic heat source of a given quantity arranged in relation to the container whereby upon ignition, the exothermic heat source will act upon a predetermined area of the tubular wall adjacent thereto;

a run-in member to transport the container into the wellbore; and an initiator to ignite the exothermic material thereby forming the window in the tubular wall.

2. The apparatus of claim 1, wherein the container portion includes an atmospheric chamber.

3. The apparatus of claim 1, wherein the exothermic heat source is disposed against a wall of the container adjacent a desired window location.

4. The apparatus of claim 1, wherein the run-in member is wireline.

5. The apparatus of claim 1, further including an anchor member for fixing the container in an axial position within the wellbore.

6. The apparatus of claim 5, wherein the anchor member fixes the container in a rotational position within the wellbore.

7. The apparatus of claim 1, wherein an additional oxidizing agent is supplied to the exothermic heat source.

8. The apparatus of claim 1, wherein exposure of the exothermic heat source to the tubular wall where the window will be formed is through a plurality of apertures formed in the container wall, the apertures forming a path of communication between the exothermic material and the tubular wall.

9. The apparatus of claim 8, wherein the plurality of apertures are formed of ceramic material.

10. The apparatus of claim 9, wherein the apertures include a diverge portion at an inner and outer openings thereof, and a convergence section therebetween.

11. The apparatus of claim 10, whereby that portion of the container including the apertures remains intact throughout the formation of the window.

12. The apparatus of claim 11, further including an opening in the container below that portion including the apertures, the opening constructed and arranged to accept spent thermite and casing wall material.

13. The apparatus of claim 1, wherein the exothermic heat source is a thermite compound.

14. The apparatus of claim 13, wherein the thermite compound comprises a mixture of aluminum and iron oxide powders.

15. The apparatus of claim 1, wherein the centerline of the apertures are substantially aligned with a radius having an origin at the centerline of the container.

16. An apparatus for forming a lateral borehole from a cased wellbore, the apparatus comprising:

a drill string having a drill bit disposed at a lower end thereof;

a diverter disposed at an end of the drill bit with a temporary connection therebetween;

a container, the container fixedly attached to a lower end of the diverter and constructed and arranged to house an exothermic heat source material;

an anchor, fixable at a predetermined location in the cased wellbore; and a telescopic joint disposed between the container and the anchor, the telescopic joint movable between an extended and a retracted position, the exothermic material thereabove adjacent an area of cased wellbore where a window is to be formed when the joint is in the extended position.

17. The apparatus of claim 16, whereby the diverter is adjacent the window formed in the cased wellbore when the telescopic joint is in the retracted position.

18. The apparatus of claim 17, whereby the temporary connection between the drill bit and the diverter terminates when the telescopic joint moves to the retracted position.

19. The apparatus of claim 18, wherein the telescopic joint moves from a first to a second position at the completion of the formation of the window in the cased wellbore.

20. The apparatus of claim 19, wherein the telescopic joint moves from the first to the second position by means of a pressure differential created therein.

21. The apparatus of claim 18, whereby the temporary connection between the drill bit and the diverter is a shearable connection that fails upon application of a predetermined force between the diverter and the drill bit.

22. The apparatus of claim 21, whereby the shearable connection fails when the joint moves from the extended to the retracted position.

23. The apparatus of claim 16, wherein the ignition of the exothermic material is controllable from the surface of the well.

24. The apparatus of claim 16, wherein the exothermic material is housed in a wall of the container, the wall having a reduced thickness in the area of the exothermic material, the wall permitting disposition of the material between an outer surface of the wall and an inner wall of the wellbore casing where the window is to be formed.

25. The apparatus of claim 16, wherein the container further includes a collection area for casing material displaced during the formation of the window.

26. The apparatus of claim 25, wherein the container further includes formations at an upper end of the container, the formations extending from the perimeter of the container and serving to remove material from a window opening as the telescopic joint moves from the extended to the retracted position.

27. A method of forming a lateral borehole from a cased wellbore, the method comprising:

running an apparatus into a wellbore, the apparatus including a drill string, a drill bit, a diverter, a container having an exothermic heat source therein, a telescopic portion and an anchor;

setting the anchor at a predetermined position in the wellbore whereby the exothermic heat source is adjacent the wellbore casing wall where the window will be formed;

initiating combustion of the exothermic heat source, causing the heat source to remove the casing in the area where a casing window is to be formed;

causing the telescopic portion to move from an extended to a retracted position after the window is formed, thereby locating the diverter adjacent the window; and lowering and rotating the drill string and drill bit to form the lateral wellbore.

28. A method of forming a window in casing downhole, the method comprising:

running an apparatus into a wellbore, the apparatus including a container having an exothermic heat source therein and an array of apertures arranged in at least two planes; and initiating combustion of the exothermic heat source, thereby causing the heat source to damage the casing in the area where the window is to be formed.

29. An apparatus for forming a window in the wall of a tubular in a wellbore, comprising:

a container portion, the container portion defining an interior space therein;

an exothermic heat source of a given quantity arranged in relation to the container and an additional oxidizing agent, whereby upon ignition, the exothermic heat source will act upon a predetermined area of the tubular wall adjacent thereto;

a run-in member to transport the container into the wellbore; and an initiator to ignite the exothermic material thereby forming the window in the tubular wall.

30. An apparatus for forming a window in the wall of a tubular in a wellbore, comprising:

a container portion, the container portion defining an interior space therein and the container portion having a wall that includes an array of apertures, wherein the apertures having a least a convergent and divergent portions;

an exothermic heat source of a given, quantity arranged in relation to the container whereby upon ignition, the exothermic heat source will act upon a predetermined area of the tubular wall adjacent thereto;

a run-in member to transport the container into the wellbore; and an initiator to ignite the exothermic material thereby forming the window in the tubular wall.

31. The apparatus of claim 30, wherein the container portion includes an atmospheric chamber.

32. The apparatus of claim 30, wherein the exothermic heat source is disposed against a wall of the container adjacent a desired window location.

33. The apparatus of claim 30, wherein the run-in member is wireline.

34. An apparatus for forming a lateral borehole from a cased wellbore, the apparatus comprising:

a drill string having a drill bit disposed at a lower end thereof;

a diverter disposed at an end of the drill bit with a temporary connection therebetween;

a container, the container fixedly attached to a lower end of the diverter and constructed and arranged to house an exothermic heat source material;

an anchor, fixable at a predetermined location in the cased wellbore; and an axially adjustable member disposed between the container and the anchor, the axially adjustable member movable between an extended and a retracted position, the exothermic material thereabove adjacent an area of cased wellbore where a window is to be formed when the axially adjustable member is in the extended position.

35. The apparatus of claim 34, whereby the diverter is adjacent the window formed in the cased wellbore when the axially adjustable member is in the retracted position.

36. The apparatus of claim 35, whereby the temporary connection between the drill bit and the diverter terminates when the axially adjustable member moves to the retracted position.

37. A method of forming a lateral borehole from a cased wellbore, the a method comprising:

running an apparatus into a wellbore, the apparatus including a drill string, a drill bit, a container having an exothermic heat source therein, an axially movable portion and an anchor;

setting the anchor at a predetermined position in the wellbore whereby the exothermic heat source is adjacent the wellbore casing wall where the window will be formed;

initiating combustion of the exothermic heat source, causing the heat source to remove the casing in the area where a casing window is to be formed;

causing the axially movable portion to move between an extended and a retracted position after the window is formed, thereby moving the container away from the casing window; and lowering and rotating the drill string and drill bit to form the lateral wellbore.

38. An apparatus for removing at least a portion of a wall of a tubular, comprising:

a container portion, the container portion defining an interior space therein and having an array of apertures in at least two planes arranged around the circumference of the container;

an exothermic heat source of a given quantity arranged in relation to the container whereby upon ignition, the exothermic heat source will act upon a predetermined area of the tubular wall adjacent thereto;

a run-in member to transport the container into the wellbore; and an initiator to ignite the exothermic material thereby removing at least a portion of the tubular wall.

39. The apparatus of claim 38, wherein the apertures are further arranged over an axial length of the container, wherein the axial length is greater than 1 circumferential row of apertures.

40. The apparatus of claim 38, wherein the centerline of the apertures are substantially aligned with a radius having an origin at the centerline of the container.

* * * * *